United States Patent [19]

Wetherell et al.

[11] 4,109,411

[45] Aug. 29, 1978

[54] TOY FIGURE GLIDER

[75] Inventors: Joseph J. Wetherell, Bedford, N.Y.; A. Edward Fogarty; Bonnie Rose Fogarty, both of Sarasota, Fla.

[73] Assignee: Ned Strongin Associates, Inc., New York, N.Y.

[21] Appl. No.: 768,076

[22] Filed: Feb. 14, 1977

[51] Int. Cl.[2] ..... A63H 27/00

[52] U.S. Cl. ..... 46/79; 46/22; 46/115

[58] Field of Search ..... 46/79, 76 R, 76 A, 81, 46/74 R, 78, 80, 115, 116, 77, 22, 17, 16, 1 R

[56] References Cited

U.S. PATENT DOCUMENTS

| | | | |
|---|---|---|---|
| 1,481,129 | 1/1924 | French | 46/22 |
| 3,293,793 | 12/1966 | Thomas, Jr. | 46/81 |
| 3,835,583 | 9/1974 | Manning | 46/201 |
| 3,952,448 | 4/1976 | Kabchef | 46/79 X |

*Primary Examiner*—Russell R. Kinsey
*Assistant Examiner*—Mickey Yu
*Attorney, Agent, or Firm*—Edward F. Levy

[57] ABSTRACT

A toy glider includes a body portion, a wing portion mounted on the body portion, and a pair of arms pivotally mounted on the body portion. The body portion is shaped to resemble a human figure and the arms are pivotable between a raised position and a lowered position both extending along and parallel to the sides of the body portion. The body portion, wing portion and arms are made of flexible resilient foam material. A mounting rod extends through the body portion and through downwardly-bent tabs in the wing portion for mounting the latter on the body portion. The arms are pivotally mounted on projecting end portions of the mounting pin.

13 Claims, 9 Drawing Figures

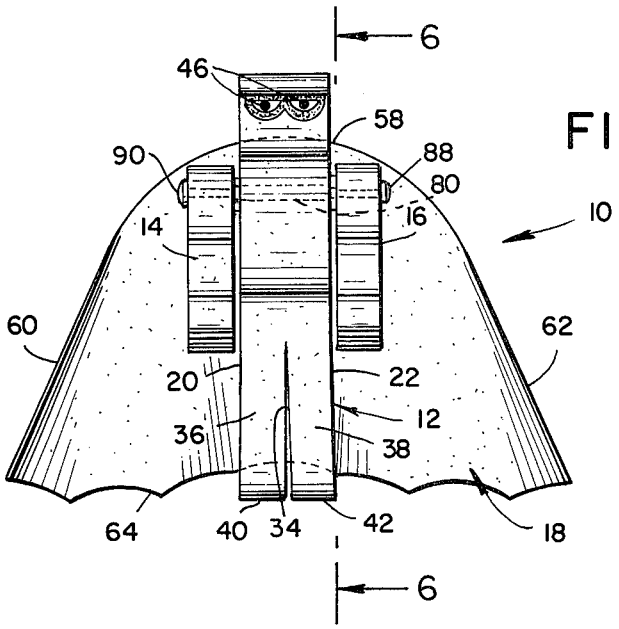
FIG. 5
FIG. 9
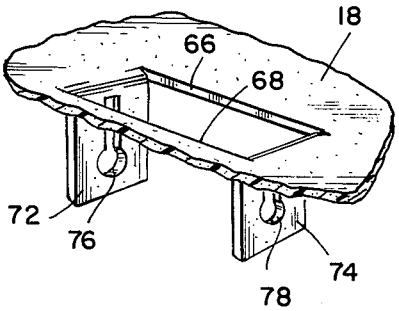
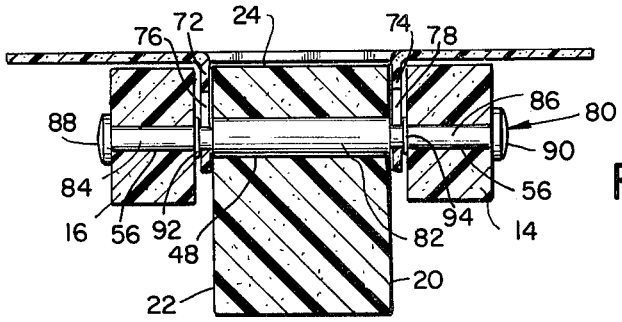
FIG. 7
FIG. 8
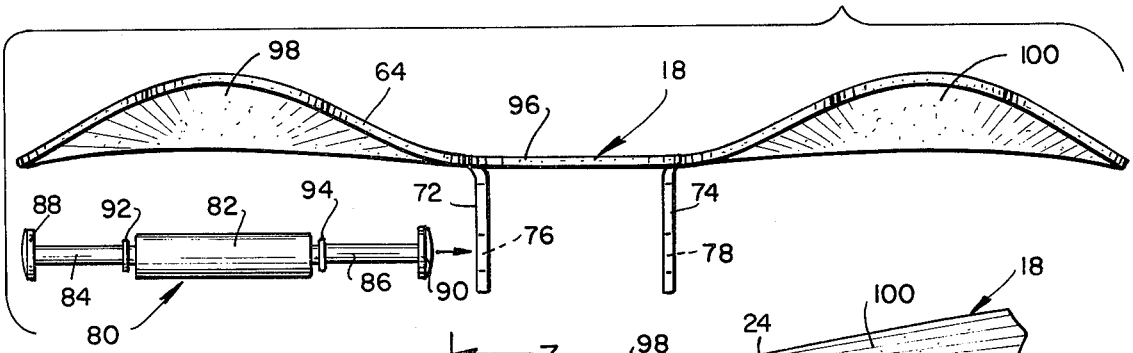
FIG. 6
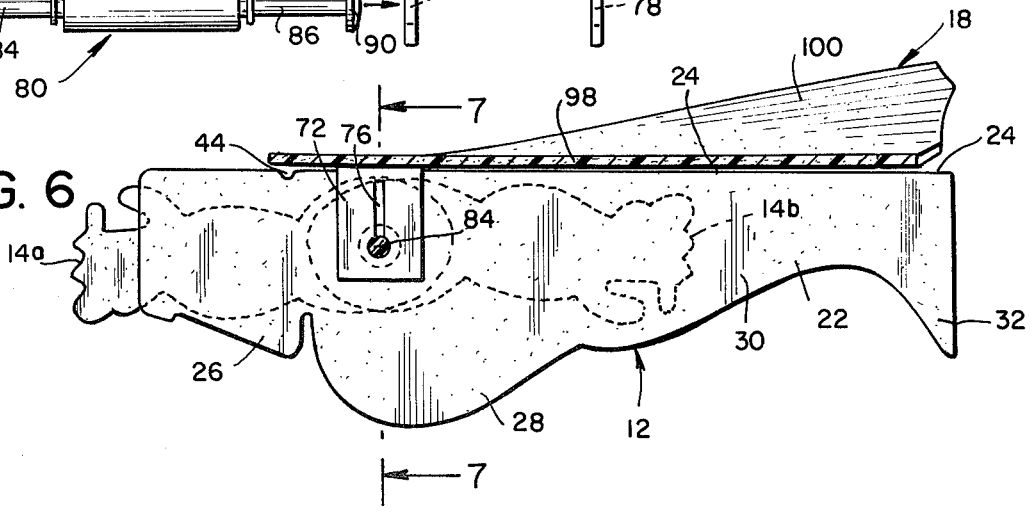

TOY FIGURE GLIDER

The present invention relates to improvements in toy gliders and in particular to a toy glider made of a foam plastic material in the form of a human figure.

Toy gliders are conventionally made of a light wood such as balsa wood or of a light rigid plastic material, and in order to impart the proper aerodynamic properties to the glider, such parts as the wings and tail elements are necessarily made thin and therefore fragile. Consequently, when used by children, the gliders are easily damaged, its parts breaking or cracking to reduce the effective life of the toy. Some conventional toy gliders are made of a foam plastic material such as polystyrene foam, but the structural components of these gliders are also easily breakable in use of the toy as well as in storage.

In addition, where the glider is made of wood, plastic or other rigid material and is flown indoors, it frequently collides with household articles and furnishings, causing damage to these articles. In the event that it strikes children or other persons in the face or other vulnerable areas, it may easily cause injury.

The toy glider of the present invention is made of a soft foam plastic material which is bendable, compressible and shape retaining so that it overcomes the aforementioned disadvantages of conventional toy gliders. In addition, the glider is made in the form of a human figure having pivoted arms so that it provides increased play value, the toy serving for use as a doll as well as a glider.

In accordance with the invention there is provided a toy figure glider including a body portion made of a soft and resilient open-cell foam material having a front surface shaped to resemble a human figure and a flat rear surface, a pair of arms made of a soft and resilient open-cell foam material and adapted to be movably mounted on the sides of said body portion, and a wing portion mounted on said body portion. The wing portion comprises a relatively thin sheet of flexible lightweight closed-cell foam material which is bendable and has shape-retaining properties, with a width appreciably greater than the width of the body portion. The wing portion is formed with downwardly-bendable mounting tabs positioned to bracket the sides of the body portion, with the lower surface of the wing portion overlying the flat rear surface of the body portion. The toy glider also includes a mounting rod which extends transversely through the body portion and through the downwardly-bent mounting tabs, thereby mounting the wing portion on the body portion. The mounting rod also extends through the arms and pivotally mounts the arms at opposite sides of the body portion.

It is an object of the present invention to provide a toy figure glider of the character described which is made of a soft and bendable foam material which renders it unbreakable in normal use and which may strike objects or persons during flight without causing damage or injury.

Another object of the invention is the provision of a toy glider made in the form of a human figure and having pivotally-mounted arms which may be selectively turned between a raised position and a lowered position, the doll being usable both as a glider and as a doll. When used as a glider, the arms may be selectively pivoted to either the raised or lowered position to vary the flight characteristics of the glider.

A further object of the invention is the provision of a toy figure glider of the character described made of a minimum number of parts for economy of manufacture, and yet being capable of soaring effectively for relatively long distances.

Additional objects and advantages of the invention will become apparent in the course of the following specification when taken in connection with the accompanying drawings in which:

FIG. 5 is a front elevational view of the toy figure glider of FIG. 1;

FIG. 6 is a section on an enlarged scale, taken along line 6—6 of FIG. 5;

FIG. 7 is a section taken along line 7—7 of FIG. 6;

FIG. 8 is a rear elevational view of the wing portion of the glider and the mounting pin thereof, showing the manner in which the mounting pin is inserted in the tabs of the wing portion; and FIG. 9 is a perspective fragmentary view of a part of the wing portion, showing the manner in which the mounting tabs are bent downwardly therefrom.

Figure 1:
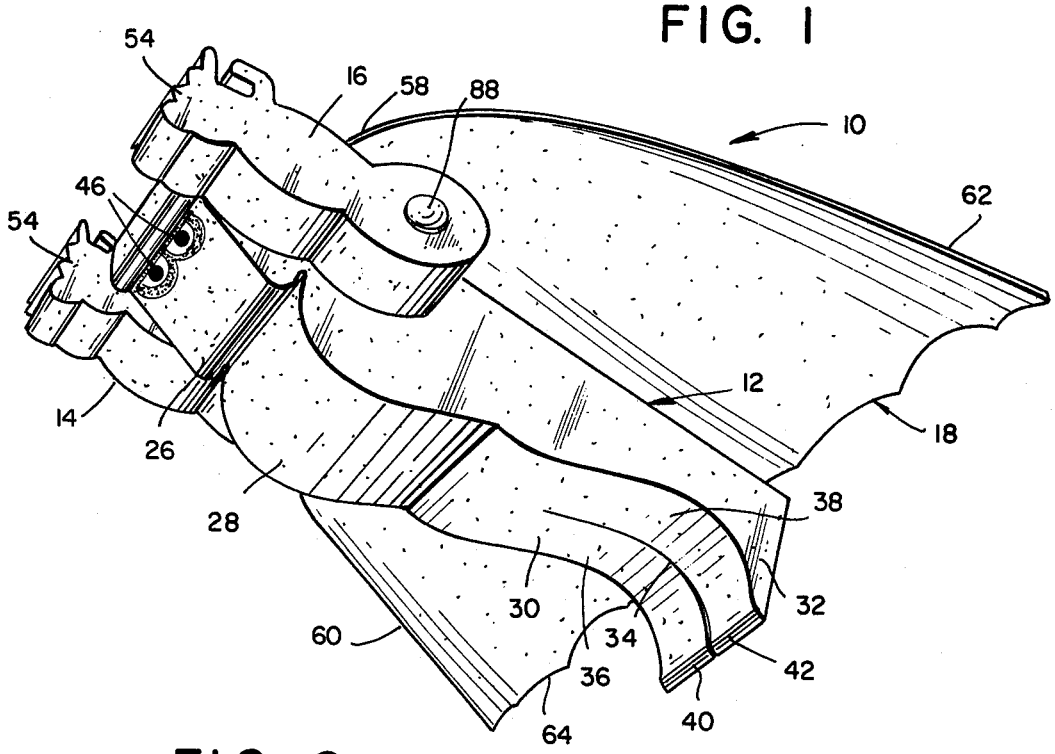
FIG. 1 is a perspective view of a toy figure glider made in accordance with the present invention, showing the arms in raised or elevated position.

Referring in detail to the drawings, there is shown in FIG. 1 a toy figure glider 10 made in accordance with the present invention. The glider 10 includes a body portion 12 shaped to resemble a human body and also serving as the fuselage of the glider, a pair of arms 14 and 16 which are pivotally mounted on the body portion 12, and a wing portion 18 which is mounted on the body portion.

The body portion 12 is made of a relatively low-density open-cell foam, such as polyurethane foam which is soft, bendable and readily compressible, and is shape retaining. Because of the low density of the foam used for body portion 12, the latter may be made of a thickness and depth considerably larger than that of gliders made of conventional materials such as balsa wood, the relatively large and bulky body portion being of very light weight and providing excellent gliding characteristics to the toy.

Figure 2:
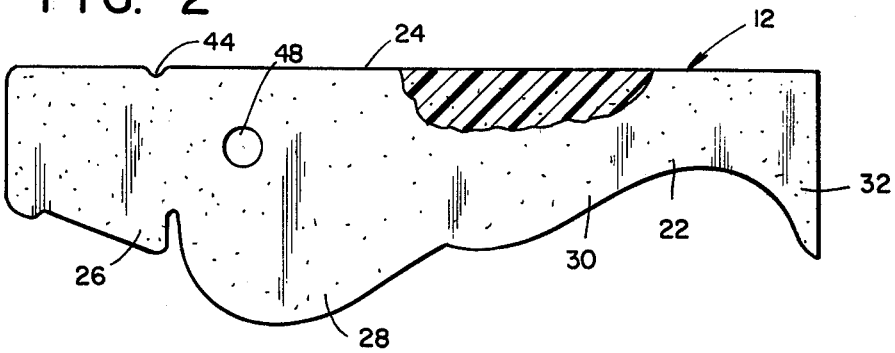
FIG. 2 is a side elevational view of the body portion of the toy figure glider.

The body portion 12 is formed with flat side walls 20 and 22 and a flat rear wall 24. As shown in FIGS. 1 and 6, the front surface of the body portion 12 is contoured to provide a head portion 26, a forwardly-projecting torso portion 28, a tapered leg portion 30 and a foot portion 32. As shown in FIG. 5, a central slit 34 through the lower portion of the body 12 defines a pair of separate legs 36 and 38 and feet 40 and 42. A transverse groove 44 may be provided in the flat rear wall 24 of the body portion 12, as shown in FIG. 2, to define the rear of the head portion 26. A pair of eyes 46 are applied to the front face surface of the head portion 26 either by printing directly thereon or by printing on a paper strip which is cemented to the head portion surface. In addition, a through circular bore 48 extends transversely through the body portion 12 at the upper or forward end of the torso portion 28, as shown in FIG. 2, to provide a mount for the pivoted arms 14 and 16 as well as for the wing portion 18, in a manner to be presently described.

Figure 4:
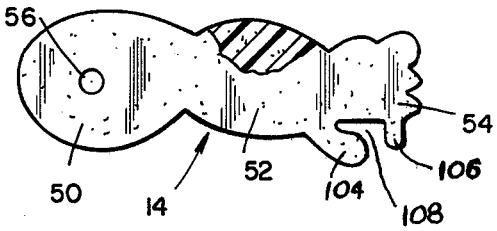
FIG. 4 is a side elevational view of one of the arms of the toy figure glider.

The arms 14 and 16 are identical, each being made of the same soft, low-density open-cell plastic foam as the body portion 12. As shown in FIG. 4, each arm 14 and 16 is shaped to provide an oval or circular arm portion 50, a forearm portion 52 and a hand portion 54. Each arm is relatively thick, and is provided with a circular bore 56 extending transversely through the center of the upper arm portion 50.

The wing portion 18 is formed of a relatively thin sheet of closed-cell elastomeric foam plastic having a somewhat greater density than the foam used for the body portion 12 and arms 14, 16. This closed-cell foam material is somewhat stiffer than the open-cell foam material of the body portion 12, and while it is easily bendable and will yield when it strikes an object, it will immediately return to its original shape.

Figure 3:
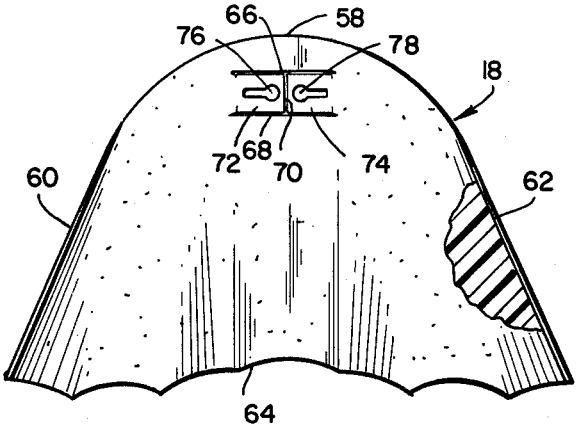
FIG. 3 is a plan view of the wing portion of the toy figure glider.

As shown in FIG. 3, the wing portion 18 is formed with an arcuate leading edge 58, outwardly tapered side edges 60 and 62, and a wide, scalloped trailing or rear edge 64. As shown, the wing portion has a large surface area relative to the width of the body portion 12. Centrally located on the wing portion 18, and spaced a short distance inwardly from the leading edge 58, are a pair of spaced, parallel transverse slits 66 and 68 which, together with a central longitudinal slit 70 therebetween, form a pair of opposed square mounting tabs 72 and 74. The tabs 72 and 74 are provided with respective keyhole slots 76 and 78 which are identical. When the wing portion 18 is to be mounted on the body portion 12, the mounting tabs 72 and 74 are folded downwardly in the manner shown in FIG. 9, so that they depend perpendicularly from the bottom surface of wing portion 18. In this downwardly-folded condition, the distance between the tabs 72 and 74 conforms to the width of the body portion 12 so that said tabs closely bracket the side walls 20 and 22 of the body portion, as shown in FIG. 7. The keyhole slots 76 and 78 are so positioned that their circular portions register with the circular bore 48 in the body portion 12 when the tabs 72 and 74 bracket the body portion.

A mounting rod 80 is also provided for the purpose of mounting both the arms 14, 16 and the wing portion 18 on the body portion 12. As shown in FIG. 8, the mounting rod 80 has a central cylindrical portion 82 of relatively large diameter, with a cylindrical pin 84 and 86 of smaller diameter extending longitudinally from each end thereof. The pins 84 and 86 terminate in respective enlarged heads 88 and 90, and are formed with respective integral circular flanges 92 and 94, each flange being spaced a short distance from the adjacent end of the central cylindrical portion 82. The length of the central cylindrical portion 82 is substantially equal to the width of the body portion 12, while the distance between each circular flange 92, 94 and its adjacent head 88, 90 is substantially equal to the width of each leg 36, 38.

In assembling the toy figure glider 10, the mounting rod 80 is inserted into and centered within the bore 48 of body member 12. Because of the flexibility and compressibility of the foam material constituting the body portion 12, the bore 48 expands in diameter to enable the enlarged head 88 or 90 and the central cylindrical portion 82 to pass therethrough. In the fully-inserted position of the mounting rod 80, shown in FIG. 7, the central cylindrical portion 82 is centered fully within the bore 48 of body portion 12 and is frictionally gripped within said bore to retard rotational movement therein. The cylindrical pins 84 and 86 project laterally from the side walls 22 and 20 of the body portion 12.

The wing portion 18 is mounted on the body portion 12 by pressing down the tabs 72 and 74 to the depending position shown in FIGS. 8 and 9, placing the wing portion 18 upon the rear wall 24 of the body portion 12, with the circular portions of keyhole slots 76 and 78 registering with the opposite ends of the circular bore 48, and inserting an end of the mounting rod 80 through the keyhole slots 76 and 78 and the circular bore 48. When the mounting rod 80 is so inserted, the elongated portions of the keyhole slots 76, 78 permit the latter to deform to enable the enlarged heads 88 and 90 of the mounting rod 80 to pass therethrough.

In the mounted position of the wing portion 18, shown in FIG. 7, the central cylindrical portion 82 of the mounting rod 80 is centrally located within the bore 48 of the body portion 12, and the cylindrical pins 84, 86 project from the opposite sides of said body portion. The circular portion of the keyhole slots 76 and 78 surround the inner ends of the projecting pins 84, 86 in the spaces between the ends of the central cylindrical portion 82 and the adjacent circular flanges 92 and 94. These flanges 92 and 94 prevent the respective mounting tabs 72 and 74 from sliding outwardly along pins 84 and 86, and maintain the mounting tabs 72 and 74 in their mounted position lying flush against the side walls 22 and 20 of body portion 12.

The arms 14 and 16 are now pivotally mounted on the mounting rod 80 by pressing said arms against the free ends of the projecting pins 84 and 86 so that the latter pass through the circular bores 56 in said arms 14 and 16. Because of the highly compressible nature of the foam material constituting said arms, the respective bores 56 expand in diameter to permit the enlarged heads 88 and 90 to pass through said bores. In the mounted positions of the arms 14 and 16, shown in FIG. 7, the arms are retained against transverse movement between the respective flanges 92, 94 and the adjacent enlarged heads 88, 90. The circular bores 56 of the arms 16 and 14 embrace the bodies of cylindrical pins 84 and 86 with slight tension so that the arms may be individually pivoted upon said pins between the raised position shown in FIG. 1 and the lowered position shown in FIG. 5. The slight tension exerted by the arm bores 56 upon the pins 84 and 86 will retain the arms frictionally in selected pivoted positions, but the arms may be easily turned to other selected positions by slight manual pressure thereon.

As shown in FIGS. 6 and 8, the wing portion 18 is formed with a flat rectangular central panel 96 and upwardly bowed side panels 98 and 100 which are tapered to increase in width from a point spaced a short distance inwardly of the leading edge 58 to the scalloped trailing edge 64. In the mounted position of the wing portion 18, the flat central panel 96 overlies and rests substantially flush upon the flat rear wall 24 of body member 12, as shown in FIGS. 6 and 7.

Since the body portion 12, and the mounted arms 14 and 16 are shaped to resemble a human figure, the toy glider 10 may be used as a doll and stood in upright position with the arms 14 and 16 pivoted to selected positions, including the raised and lowered positions and a variety of extended positions therebetween. When used as a doll, the wing portion 18 is shaped to resemble a cape for the human figure.

When the toy is used as a glider, it is held in the position shown in FIG. 6 with the body portion 12 facing downwardly and the wing portion 18 facing upwardly, and the user's fingers gripping the body portion adjacent the center thereof. From this position, the glider is propelled through the air, and will glide gracefully in the aforementioned upright position. The relatively large area of the wing section 18, together with the bowed shape of the outer wing panels 98 and 100 imparts effective aerodynamic properties to the glider, providing a degree of lift which results in flights of relatively long distances. These aerodynamic characteristics, coupled with the light weight of both the wing and body portions, enables even a small child to throw the glider in a level position through long distances. When the glider is flown, it is preferable that the arms 14 and 16 be turned and maintained parallel to the axis of the body portion 12 in either their raised or lowered positions. When the arms project forwardly of the body portion, they create a drag which interferes with the effective flight of the glider. The toy figure glider 10 may thus be sailed with the arms 14 and 16 aligned either in the raised position shown at 14*a* in FIG. 6 or in the lowered position shown at 14*b*. When the arms are selectively adjusted from one of these positions to the other, the center of gravity of the glider is shifted, resulting in a different flight pattern.

Because the wing portion 18 and body portion 12 are both made of soft and resilient foam plastic material, the toy glider 10 may be safely thrown for relatively long distances without causing damage to surrounding articles which it may strike, or causing injury to persons in the line of flight. It will also be appreciated that since the parts of the glider, particularly the wing portion 18 is made of a shape-retaining foam material, the latter may be bent or deformed in use, but will immediately return to its original configuration.

In addition to its function in mounting the wing portion 18 and pivotally mounting the arms 14 and 16 on the body member 12, the mounting rod 80 also serves as a balance weight for the toy glider. The mounting rod is made of a rigid plastic material, and since it is located within the body portion 12 beneath the forward end portion of the wing member 18, its weight balances the glider during flight and functions to improve the flight characteristics of said glider.

The hand portion 54 on each of the arms 14 and 16 is provided with a projecting thumb 104 and finger 106 forming an L-shaped slot 108 therebetween. A rolled paper message or other light articles may be inserted into the slot 108 and will remain therein gripped by the resilience of the thumb 104 and finger 106 during the flight of the glider, thereby increasing the play value of the toy.

While a preferred embodiment of the invention has been shown and described herein, it is obvious that numerous omissions, changes and additions may be made in such embodiment without departing from the spirit and scope of the invention.

What is claimed is:

1. A toy figure glider comprising a body portion made of a soft and resilient open-cell foam material having a front surface and a flat rear surface, a pair of arms made of a soft and resilient open-cell foam material and adapted to be movably mounted on the sides of said body portion, a wing portion comprising a relatively thin sheet of flexible, light-weight, closed-cell foam material which is bendable and has shape-retaining properties, and having a width appreciably greater than the width of said body portion, said wing portion having connecting means for attaching said wing portion to said body portion with the lower surface of said wing portion closely overlying the flat near surface of said body portion and extending substantially parallel thereto, and a mounting rod extending transversely through said body portion and through said connecting means for mounting said wing portion on said body portion, said mounting rod also extending through said arms for pivotally mounting said arms at opposite sides of said body portion, said pivotally-mounted arms being selectively movable to forwardly-extending and rearwardly-extending positions in which they are parallel to the axis of said body portion for launching of the glider through the air with the body portion substantially horizontal and facing downwardly and the wing portion facing upwardly.

2. A toy figure glider comprising a body portion made of a soft and resilient open-cell foam material having a front surface and a flat rear surface, a pair of arms made of a soft and resilient open-cell foam material and adapted to be movably mounted on the sides of said body portion, a wing portion comprising a relatively thin sheet of flexible, light-weight, closed-cell foam material which is bendable and has shape-retaining properties, and having a width appreciably greater than the width of said body portion, said wing portion having connecting means for attaching said wing portion to said body portion with the lower surface of said wing portion overlying the flat rear surface of said body portion, and a mounting rod extending transversely through said body portion and through said connecting means for mounting said wing portion on said body portion, said mounting rod also extending through said arms for pivotally mounting said arms at opposite sides of said body portion, said connecting means including a pair of downwardly-bendable cut-out mounting tabs formed on said wing portion and positioned to bracket the sides of said body portion when said wing portion is mounted on said body portion, said mounting rod extending transversely through said downwardly-bent mounting tabs.

3. A toy figure glider according to claim 1 in which the front surface of said body portion is shaped to resemble a human figure.

4. A toy figure glider according to claim 1 in which said wing portion has an arcuate leading edge, outwardly-tapered side edges, and a wide, scalloped trailing edge.

5. A toy figure glider according to claim 4 in which said wing portion has a flat, rectangular central section overlying the flat rear surface of said body portion, and upwardly-bowed tapered side sections which increase in width from the forward portion of said wing section to the trailing edge thereof.

6. A toy figure glider according to claim 4 in which the flat, rectangular central section of said wing portion is formed with a pair of spaced transverse slits and a longitudinal slit extending between the centers of said transverse slits to form said mounting tabs.

7. A toy figure glider according to claim 2 in which each of said mounting tabs is formed with a keyhole slot having a circular portion, and said body portion is formed with a transverse through bore therein, the circular portions of said keyhole slots being positioned to register with the respective ends of said transverse through bore when said wing portion is mounted on said body portion.

8. A toy figure glider according to claim 7 in which said mounting rod has a cylindrical central section having a length substantially equal to the width of said body portion and a pair of cylindrical pins of lesser diameter extending axially from the respective opposite ends of said central section, said cylindrical portion having a diameter greater than the diameter of the through bore in said body portion and being sized to be inserted and frictionally retained within said through bore with said pair of cylindrical pins projecting laterally from opposite sides of said body portion.

9. A toy figure glider according to claim 8 in which said mounting rod is made of a rigid material of sufficient weight to balance the glider during flight thereof.

10. A toy figure glider according to claim 8 in which said mounting rod has integral flanges projecting radially from said mounting pins and spaced a short distance from the respective ends of said cylindrical central section, and enlarged terminal heads at the free ends of the respective cylindrical pins.

11. A toy figure glider according to claim 10 in which said cylindrical pins extend through the circular portions of the keyhole slots of the respective mounting tabs, with each mounting tab located in the space between a respective flange and the adjacent end of said cylindrical central section.

12. A toy figure glider according to claim 11 in which each of said arms is formed with a transverse through bore, the outer end portions of said cylindrical pins extending through the through bores of the respective arms, with each arm located between a respective flange and terminal head of said mounting pin and being pivotally movable upon said mounting pin between a raised position parallel to the longitudinal axis of said body portion and a lowered position parallel to the longitudinal axis of said body portion.

13. A toy figure glider according to claim 1 in which said body portion has a flat bottom surface aligned with the trailing edge of said wing portion, whereby said toy figure glider may be stood in upright position with said flat bottom surface and said trailing edge resting upon a support surface.

* * * * *